US005580272A

United States Patent [19]

Yamaguchi et al.

[11] Patent Number: 5,580,272

[45] Date of Patent: Dec. 3, 1996

[54] FLEXIBLE BOARD ELECTRICAL CONNECTOR

[75] Inventors: Tomisaburo Yamaguchi; Ryuichi Takayasu, both of Tokyo, Japan

[73] Assignee: Hirose Electric Co., Ltd., Tokyo, Japan

[21] Appl. No.: 415,132

[22] Filed: Mar. 30, 1995

[30] Foreign Application Priority Data

Aug. 5, 1994 [JP] Japan ..... 6-203009

[51] Int. Cl.[6] ..... H01R 9/07

[52] U.S. Cl. ..... 439/495; 439/260

[58] Field of Search ..... 439/495, 569, 439/620, 492, 493, 499, 77, 67

[56] References Cited

U.S. PATENT DOCUMENTS

| | | | |
|---|---|---|---|
| 5,194,017 | 3/1993 | Consoli | 439/495 |
| 5,213,534 | 5/1993 | Gardner et al. | 439/495 |
| 5,240,430 | 8/1993 | Soes | 439/495 |

FOREIGN PATENT DOCUMENTS

| | | | |
|---|---|---|---|
| 000492091 | 7/1992 | European Pat. Off. | 439/492 |

*Primary Examiner*—Neil Abrams
*Assistant Examiner*—Eugene G. Byrd
*Attorney, Agent, or Firm*—Kanesaka & Takeuchi

[57] ABSTRACT

A flexible board electrical connector to be mounted on a board, such as a printed circuit board, which includes a housing having an insertion opening; a plurality contact elements disposed in the housing so that spring contact portions of the contact elements are exposed in the insertion opening; a bearing portion provided on the contact elements; a pressure lever rotatable on the bearing portion between an open position and a pressure position; and a pressure edge provided on the pressure lever so that when the pressure lever is turned to the pressure position, the pressure edge moves in a direction opposite to an insertion direction of a flexible board and presses the flexible board against the spring contact portions, thus providing connections between the flexible board and the contact elements.

7 Claims, 6 Drawing Sheets

FLEXIBLE BOARD ELECTRICAL CONNECTOR

BACKGROUND OF THE INVENTION

1. Field of the Invention

The present invention relates to electrical connectors for flexible boards.

2. Description of the Related Art

Japanese patent application Kokoku No. 4-33671 discloses a low plugging force connector such as shown in FIG. 6. The connector includes a housing 51 having an insertion opening at the upper left corner and a pressure lever 52 attached to the housing for rotation about an axis 52A. The pressure lever 52 is rotatable clockwise up to a pressure position as shown by a broken line, with a convex cylindrical surface 53 thereof sliding on a concave cylindrical surface 54 of the housing 51.

A number of J-shaped contact elements 55 are disposed along the length of the housing 51. Each contact element 55 has a spring contact portion 55A and a connection portion 55B projecting downwardly from the housing 51 through a hole of a printed circuit board P.

The pressure lever 52 has two flat surfaces 52B and 52C joined together to provide an angular pressure edge 52D. When the pressure lever 52 is rotated to the pressure position, the pressure edge 52D moves downwardly along the flexible board F and presses the flexible board F against the contact portions 55A of the contact elements 55.

The use of the electrical connector is as follows. A flexible board F is inserted into a space between the contact elements 55 and the pressure lever 52 which is in an open position as shown in a solid line. Then, the pressure lever 52 is turned clockwise so that the pressure edge 52D moves downwardly along the flexible board F and presses the flexible board F against the contact portions 55A, making connections between the conductors of the flexible board F and the corresponding contact elements 55.

However, when the pressure lever 52 is turned to the pressure position, the contact points or line between the pressure edge 52D and the flexible board F moves downwardly with increasing pressure. That is, the flexible board F receives a downward force.

As a result, the pressure lever 52 receives an upward reactive force. If the reactive force is very large, the pressure lever 52 can come off from concave cylindrical surface 54 of the housing 51.

In addition, the downward force tries to push the flexible board beyond the limit so that the flexible board can be deformed, causing poor connections.

SUMMARY OF THE INVENTION

Accordingly, it is an object of the invention to provide a flexible board electrical connector wherein the pressure lever receives no or little reactive force, thus minimizing poor connections otherwise caused by the deformation of the flexible board.

It is another object of the invention to provide a flexible board electrical connector which is not separated from the printed circuit board when a flexible board is connected.

According to an aspect of the invention there is provided a flexible board electrical connector to be mounted on a board, such as a printed circuit board, which includes a housing having an insertion opening; a plurality contact elements disposed in said housing so that spring contact portions of said contact elements are exposed in said insertion opening; a bearing portion provided on said contact elements; a pressure lever rotatable on said bearing portion between an open position and a pressure position; and a pressure edge provided on said pressure lever so that when said pressure lever is turned to said pressure position, said pressure edge moves in a direction opposite to an insertion direction of a flexible board and presses said flexible board against said spring contact portions, thus providing connections between said flexible board and said contact elements.

According to another aspect of the invention there improvised a flexible board electrical connector, wherein said housing has a mounting face on a side opposite to said spring contact portions with respect to said bearing portion; said pressure lever is provided with a guiding space for guiding said flexible board into said insertion opening; an operation portion is provided at a position opposite to said mounting surface with respect to said guiding space; and said pressure lever is turned toward said mounting surface to said pressure position, thereby minimizing separation of said housing from said board.

According to still another aspect of the invention there is provided a flexible board electrical connector, wherein said insertion opening is provided on a top surface of said housing so that said flexible board is inserted into said insertion opening from above; said housing is mounted on a circuit board on its bottom surface; and said pressure lever is turned downwardly toward said board to said pressure position.

In operation, first of all, the pressure lever is turned to the open position so that the pressure edge is deep in the insertion opening and away from the spring contact portions. Under this condition, a flexible board is inserted into the insertion opening between the pressure edge and the spring contact portions. Then, the pressure lever is turned to the pressure position so that the pressure edge moves from rear to front of the insertion opening and presses the flexible board against the spring contact portions, making electrical connections between the flexible board and the contact elements.

Alternatively, a flexible board is inserted through the guiding space of the pressure lever in the open position and, then, the pressure lever is turned to bring the pressure edge into the pressure position. According to the invention, the pressure lever is brought into the pressure position by always turning it toward the printed circuit board, thereby minimizing separation of the housing from the printed circuit board.

The above and other objects, features, and advantages of the invention will be more apparent from the following description when taken in conjunction with the accompanying drawings.

DESCRIPTION OF THE PREFERRED EMBODIMENTS

Figure 1:
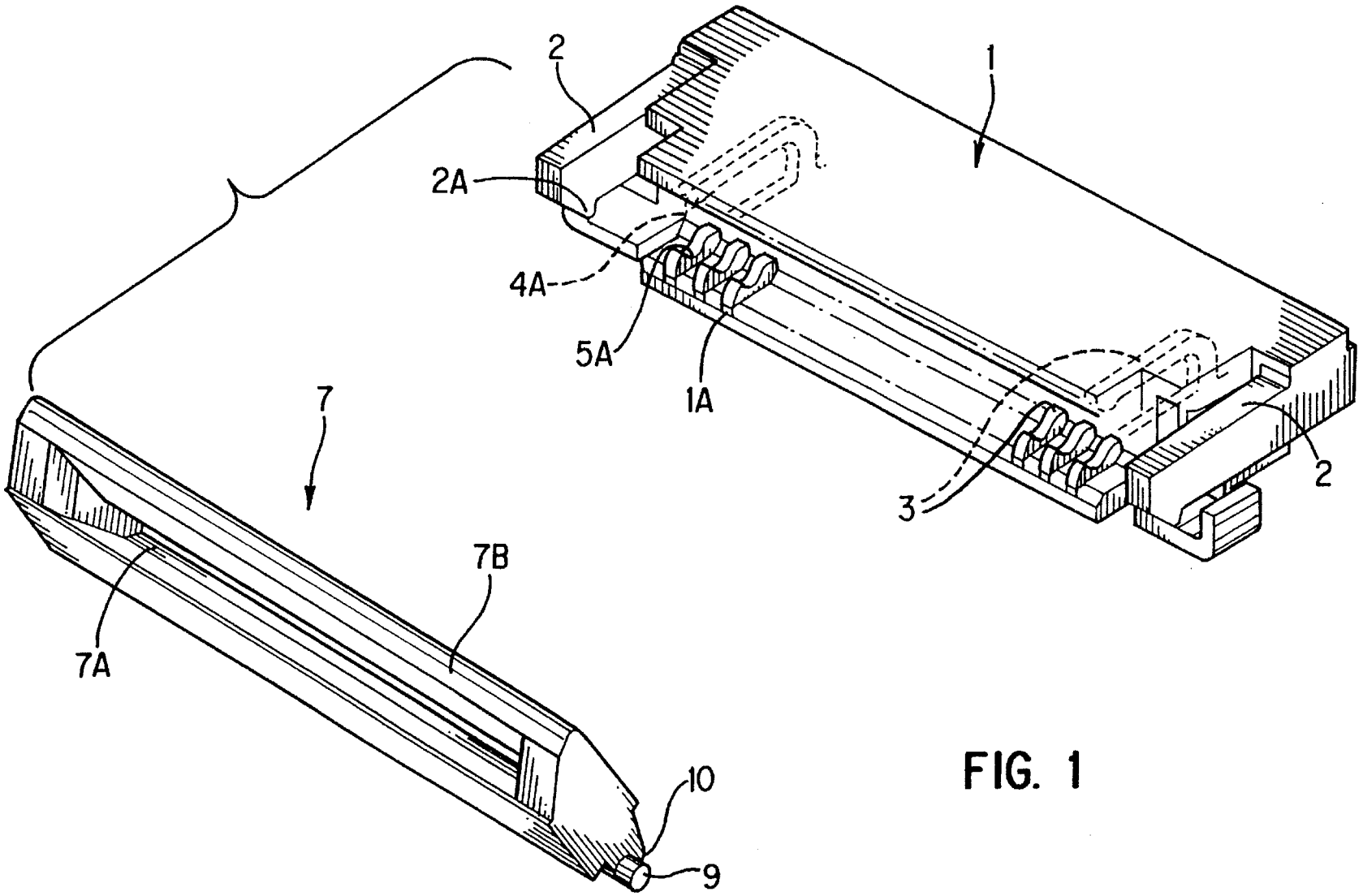
FIG. 1 is an exploded perspective view of an electrical connector according to an embodiment of the invention.
Figure 2:
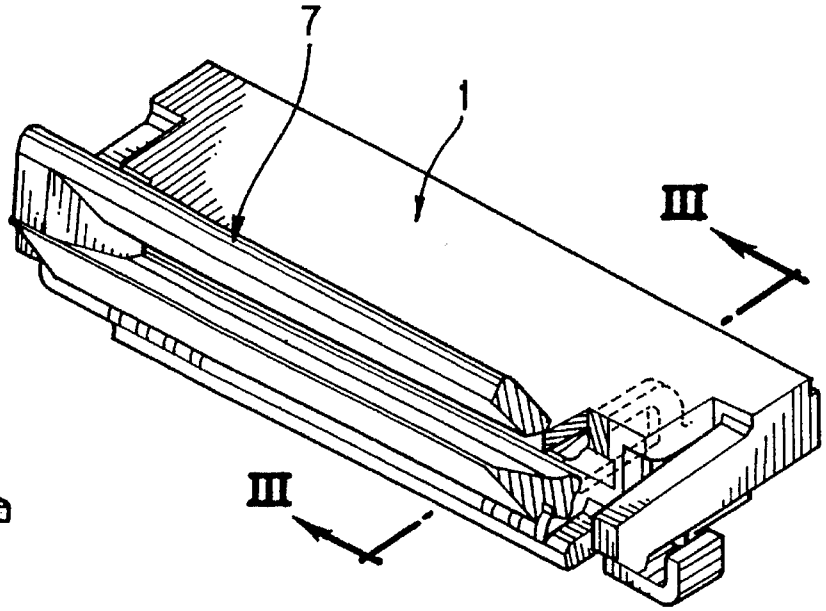
FIG. 2 is a partially cutaway perspective view of the electrical connector.
Figure 2:
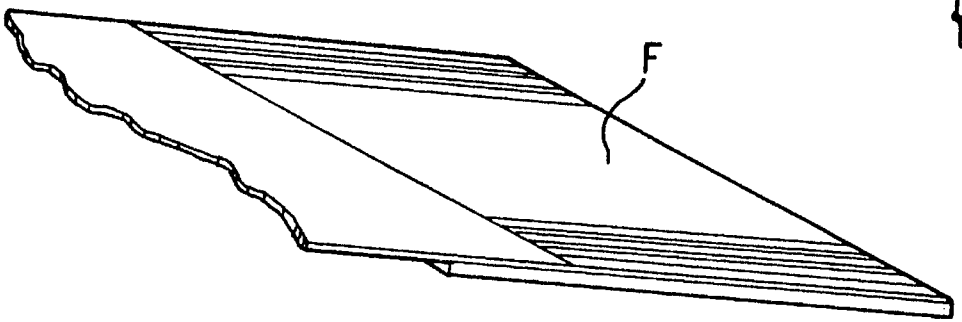
Figure 3:
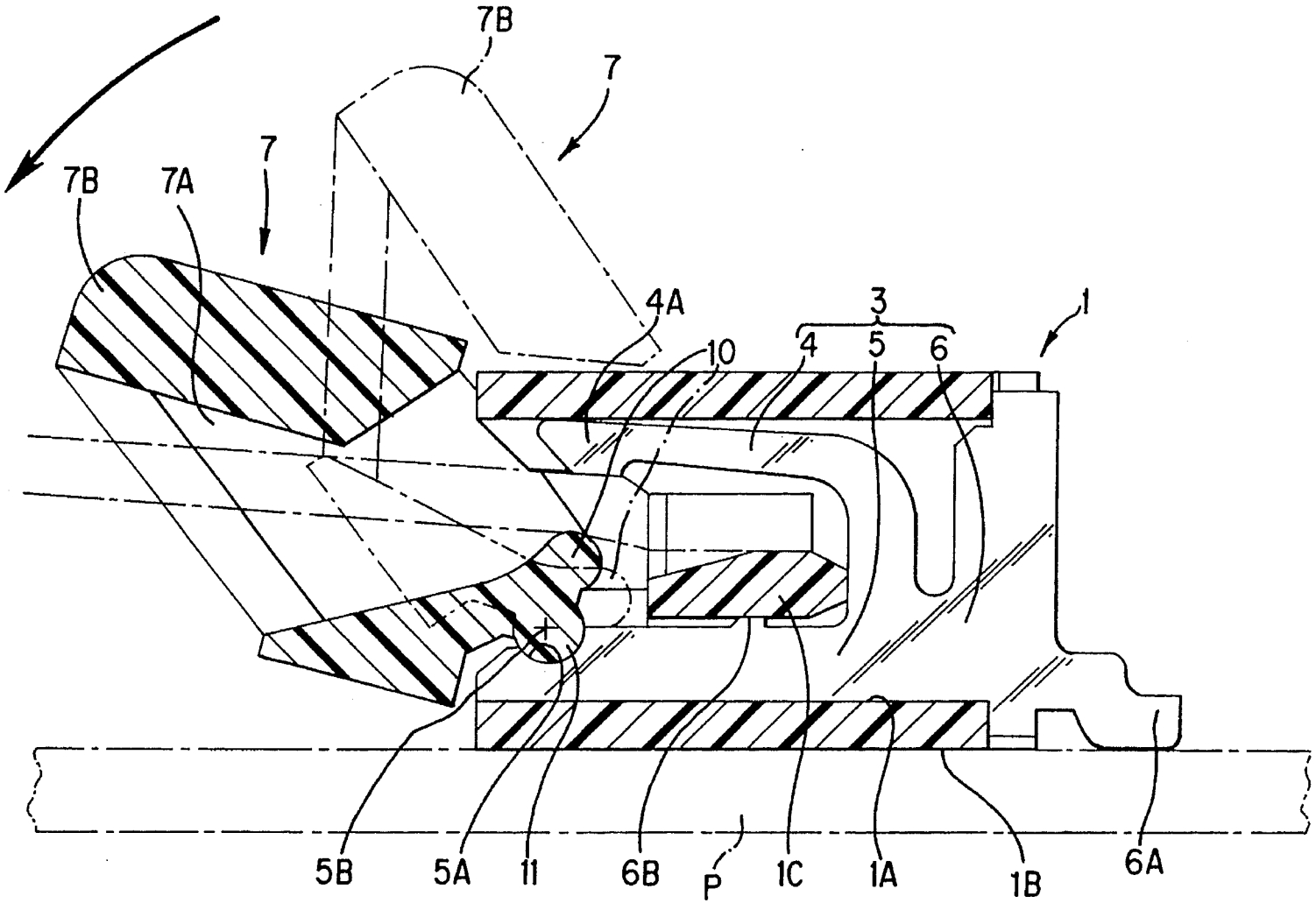
FIG. 3 is a cross section taken along line III—III of FIG. 2.

In FIGS. 1–3, a housing 1 is made from an insulating material so as to provide an insertion opening at the left-hand side as shown. The housing 1 has a pair of support flanges 2 on opposite sides thereof and a number of retention grooves 1A formed at regular intervals between the support flanges 2 for receiving contact elements 3. A pair of bearing projections 2A are formed on the lower ends of the support flanges 2 for holding shaft portions 9 of a pressure lever 7.

As best shown in FIG. 3, each contact element 3 is made by stamping a metal sheet so as to provide a base portion 6, an arm portion 5 extending forwardly from the base portion 6, a finger portion 4 extending upwardly and then forwardly from the arm portion 5, and a connection portion 6A extending rearwardly from the base portion 6 and projecting from the housing 1. The end portion of the connection portion 6A extends downwardly to a level equal to the bottom lB of the housing 1 so that when the housing 1 is mounted on the PCB P, the connection portion 6A is brought into contact with a predetermined circuit portion for soldering. The arm portion 5 has a semi-circular concave bearing 5A at the front end. The finger portion 4 has a contact tip 4A facing toward the concave bearing 5A. The concave bearing 5A and the cylindrical bearing 2A of the support flanges 2 are concentric. The contact elements 3 are press-fitted into the retention grooves 1A from the back of the housing 1 and held in place with retention claws 6B engaging with a bottom surface of a guiding portion 1C above the retention grooves 1A.

A pressure lever 7 is pivotally mounted in the insertion opening of the housing. The pressure lever 7 has a convex pressing portion 10 and a pair of shaft portions 9 extending axially from the pressure lever 7. The shaft portions 9 have a diameter substantially equal to that of the cylindrical bearings 2A so that they are supported by the cylindrical bearings 2A for rotation. A cylindrical portion 11 is formed adjacent to the pressing portion 10 so that when the shaft portions 9 are placed in the circular bearings 2A, it rests on the concave bearings 5A of contact elements 3 which are disposed in the retention grooves 1A. The concave bearings 5A are made from metal and provide a very strong support for the pressure lever 7.

The pressure lever 7 has a guiding space 7A between an upper operation portion 7B and the pressing and cylindrical portions 10 and 11 for guiding a flexible board F into the opening. Alternatively, the guiding space 7A may be curved upwardly having an insertion port on the top surface of the pressure lever 7.

A flexible board is connected to the electrical connector in the following manner.

(1) As shown in FIG. 3, the operation portion 7B is lifted to bring the pressure lever 7 to an open position shown by a broken line. In the open position, the pressing portion 10 is so away from the contact tips 4A of contact elements 3 that there is provided a sufficiently large entry space between the pressing portion 10 and the contact tips 4A to receive a flexible board F.

(2) A flexible board F is inserted into the entry space through the guiding space 7A until it hits the rear wall of the insertion opening.

Figure 4:
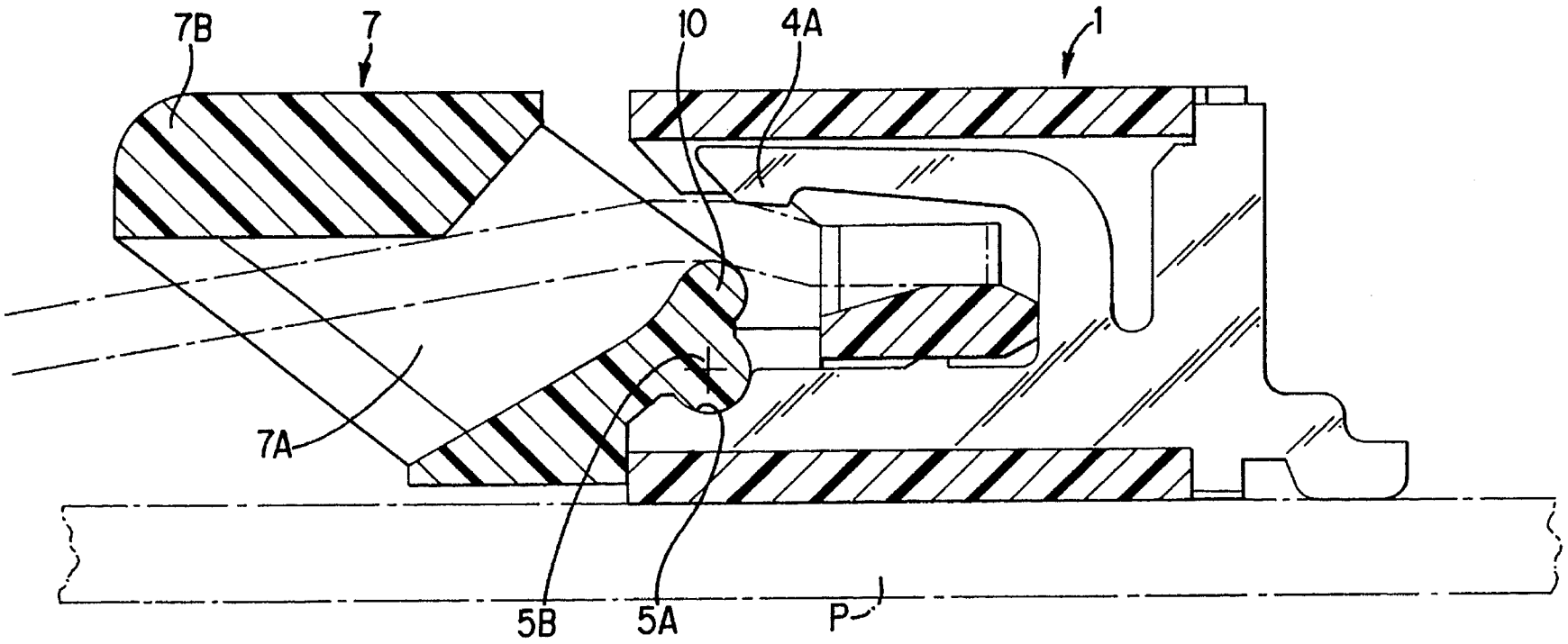
FIG. 4 is a cross section similar to FIG. 3, wherein the pressure lever is in a pressure position.

(3) As shown in FIG. 4, the pressure lever 7 is turned counterclockwise so that the pressing portion 10 moves upwardly and presses the flexible board F against the contact tips 4A of contact elements 4.

(4) The flexible board F is bent downwardly by the upper wall of the guiding space 7A, minimizing falling off from the connector housing 1.

Figure 5:
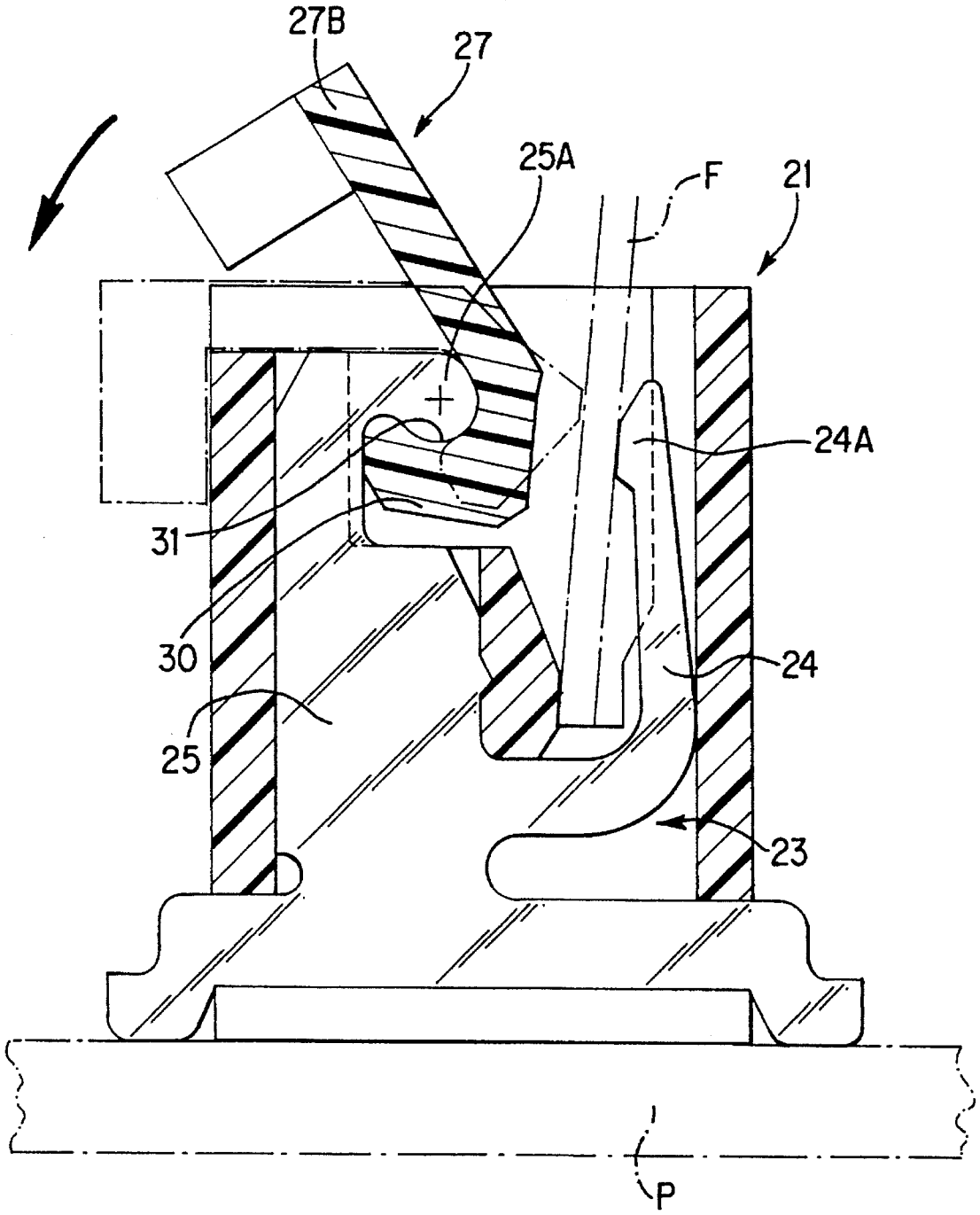
FIG. 5 is a sectional view of an electrical connector according to another embodiment of the invention.
Figure 6:
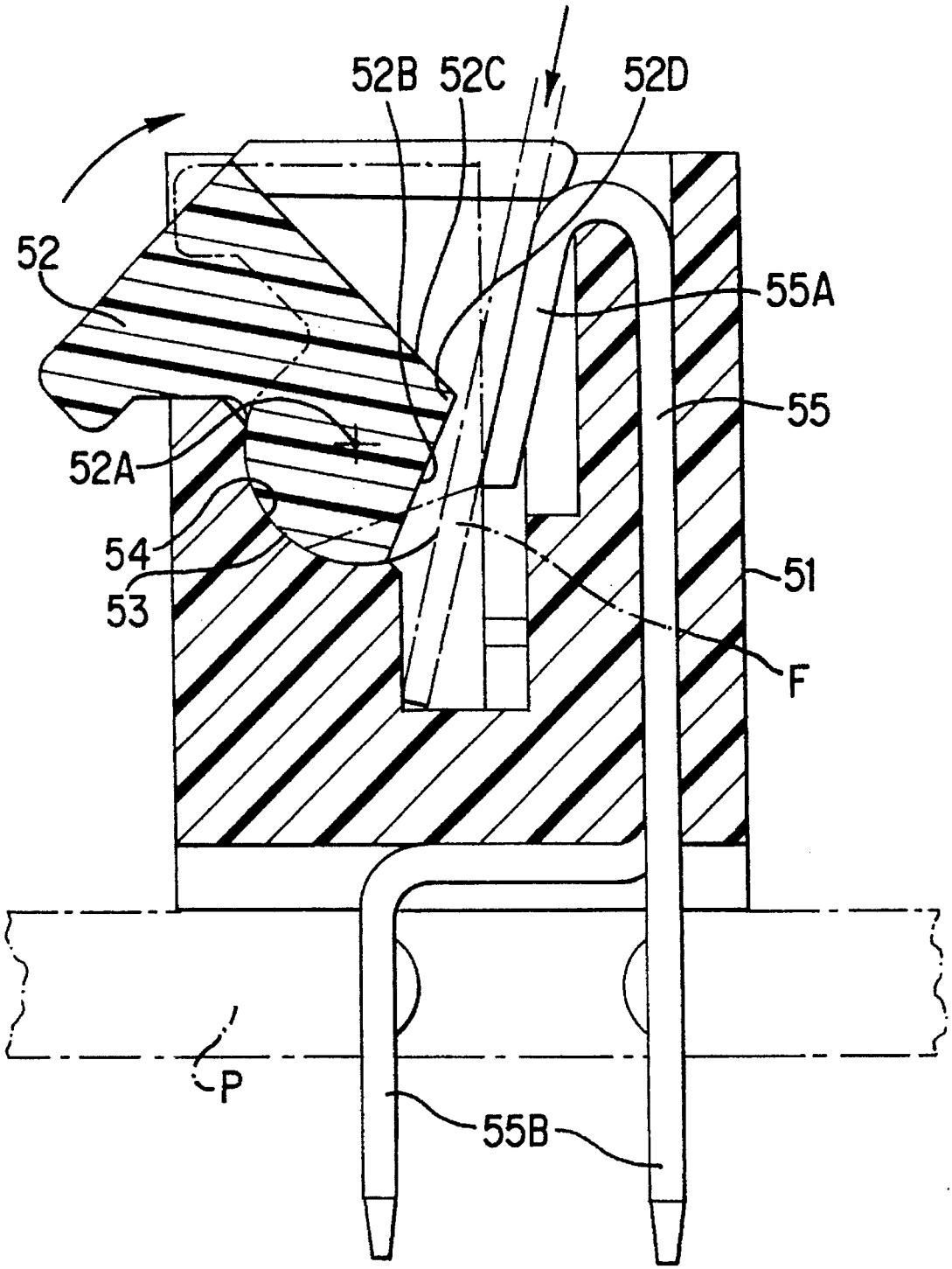
FIG. 6 PRIOR ART
FIG. 6 is a sectional view of a conventional electrical connector.

In FIG. 5, a housing 21 has an insertion opening on the top surface, and a flexible board F is inserted into the opening from above. That is, in this embodiment, the flexible board F is inserted in the direction substantially perpendicular to the printed circuit board P while, in the first embodiment, the flexible board F is inserted into the opening in the direction substantially parallel to the printed circuit board.

A finger portion 24 of a contact element 23 is substantially identical with that of the first embodiment and has a contact tips 24A. An arm portion 25 has a substantially circular portion 25A at the tip to support a pressure lever 27 for rotation.

The pressure lever 27 has a substantially semicircular concave portion 31 for engagement with the circular portion 25A and a pressure edge 30 at a position opposite to the concave portion 31, and an operation portion 27B on the end.

To insert a flexible board F, the pressure lever 27 is turned clockwise to the open position as shown by a solid line, making a large space between the pressure edge 30 and the contact portions 24A. Under this condition, the flexible board F is inserted from above.

Then, the pressure lever 27 is turned counterclockwise to the pressure position shown by a broken line so that the pressure edge 30 moves upwardly along the flexible board F and presses the flexible board F against the contact portions 24A.

As described above, the pressure edge of the pressure lever moves in the direction opposite to the insertion direction of the flexible board so that the pressure lever does not fall off from the housing under the reactive force by the flexible board. In addition, the flexible board is not pushed into the insertion opening beyond the limit by the pressure edge, thus preventing the poor contact otherwise caused by the deformation of the flexible board.

Moreover, the pressure lever is turned toward the circuit board to the pressure position regardless of the insertion direction of a flexible board so that the housing is pressed against the circuit board, thus preventing the housing from being lifted off or separated from the PCB.

We claim:

1. A flexible board electrical connector to be mounted on a board, such as a printed circuit board, comprising:

a housing having an insertion opening;

a plurality contact elements disposed in said housing so that spring contact portions of said contact elements are exposed in said insertion opening;

a bearing portion provided on said contact elements;

a pressure lever rotatable on said bearing portion between an open position and a pressure position; and a pressure edge provided on said pressure lever so that when said pressure lever is turned to said pressure position, said pressure edge moves in a direction opposite to an insertion direction of a flexible board and presses said flexible board against said spring contact portions, thus providing connections between said flexible board and said contact elements.

2. A flexible board electrical connector according to claim 1, wherein said housing has a mounting face on a side opposite to said spring contact portions with respect to said bearing portion; said pressure lever is provided with a guiding space for guiding said flexible board into said insertion opening; an operation portion is provided at a position opposite to said mounting surface with respect to said guiding space; and said pressure lever is turned toward said mounting surface to said pressure position, thereby minimizing separation of said housing from said board.

3. A flexible board electrical connector according to claim 1, wherein said insertion opening is provided on a top surface of said housing so that said flexible board is inserted into said insertion opening from above; said housing is mounted on a circuit board on its bottom surface; and said pressure lever is turned downwardly toward said board to said pressure position.

4. A flexible board electrical connector according to claim 1, wherein said bearing portion has a concave cross section while said pressure lever has a ridge portion with a convex cross section which fits in said concave bearing portion for rotation.

5. A flexible board electrical connector according to claim 3, wherein said bearing portion has a convex cross section while said pressure lever has a recess with a concave cross section which fits over said convex bearing portion for rotation.

6. A flexible board electrical connector according to claim 1, wherein said pressure edge has a semicircular cross section.

7. A flexible board electrical connector according claim 3, wherein said pressure edge is made from a rounded corner.

* * * * *